US007169538B2

(12) United States Patent
Bertelsen et al.

(10) Patent No.: US 7,169,538 B2
(45) Date of Patent: Jan. 30, 2007

(54) PROCESS FOR MAKING A MICRO-FLUID EJECTION HEAD STRUCTURE

(75) Inventors: Craig M. Bertelsen, Union, KY (US); Brian C. Hart, Georgetown, KY (US); Gary A. Holt, Jr., Lexington, KY (US); Gary R. Williams, Lexington, KY (US); Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 260 days.

(21) Appl. No.: 10/937,968

(22) Filed: Sep. 10, 2004

(65) Prior Publication Data

US 2006/0057503 A1 Mar. 16, 2006

(51) Int. Cl.
*B41J 2/16* (2006.01)

(52) U.S. Cl. ..... 430/320; 347/47

(58) Field of Classification Search ..... None
See application file for complete search history.

(56) References Cited

U.S. PATENT DOCUMENTS

| | | | | |
|---|---|---|---|---|
| 4,558,333 | A * | 12/1985 | Sugitani et al. | 347/65 |
| 4,609,427 | A | 9/1986 | Inamoto et al. | |
| 4,657,631 | A | 4/1987 | Noguchi | |
| 6,409,312 | B1 * | 6/2002 | Mrvos et al. | 347/54 |
| 6,440,218 | B1 | 8/2002 | Sanada et al. | |
| 6,652,911 | B2 | 11/2003 | Kim et al. | |
| 2002/0145644 | A1 | 10/2002 | Chen et al. | |

* cited by examiner

*Primary Examiner*—John A. McPherson
(74) *Attorney, Agent, or Firm*—Luedeka, Neely & Graham

(57) ABSTRACT

A device surface of a substrate is dry-sprayed with a polymeric material (e.g., a photoresist) to provide a spray-coated layer on the surface of the substrate. The spray-coated layer has a thickness ranging from about 0.5 to about 20 microns. Flow features are formed (e.g., imaged and developed) in the spray-coated layer. A nozzle plate layer is applied to the spray-coated layer. The nozzle plate layer has a thickness ranging from about 5 to about 40 microns and contains nozzle holes formed therein to provide the micro-fluid ejection head structure.

26 Claims, 4 Drawing Sheets

PROCESS FOR MAKING A MICRO-FLUID EJECTION HEAD STRUCTURE

FIELD

The disclosure relates to micro-fluid ejection devices, and in particular to improved methods for making micro-fluid ejection head structures

BACKGROUND

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or micro-fluid ejection head itself. This seemingly simple device is a relatively complicated structure containing electrical circuits, ink passageways and a variety of tiny parts assembled with precision to provide a powerful, yet versatile micro-fluid ejection head. The components of the ejection head must cooperate with each other and with a variety of ink formulations to provide the desired print properties. Accordingly, it is important to match the ejection head components to the ink and the duty cycle demanded by the printer. Slight variations in production quality can have a tremendous influence on the product yield and resulting printer performance.

The primary components of a micro-fluid ejection head are a semiconductor substrate, a nozzle plate and a flexible circuit attached to the substrate. The semiconductor substrate is preferably made of silicon and contains various passivation layers, conductive metal layers, resistive layers, insulative layers and protective layers deposited on a device surface thereof. Fluid ejection actuators formed on the device surface may be thermal actuators or piezoelectric actuators. For thermal actuators, individual heater resistors are defined in the resistive layers and each heater resistor corresponds to a nozzle hole in the nozzle plate for heating and ejecting fluid from the ejection head toward a desired substrate or target.

The nozzle plates typically contain hundreds of microscopic nozzle holes for ejecting fluid therefrom. A plurality of nozzle plates are usually fabricated in a polymeric film using laser ablation or other micro-machining techniques. Individual nozzle plates are excised from the film, aligned, and attached to the substrates on a multi-chip wafer using an adhesive so that the nozzle holes align with the heater resistors. The process of forming, aligning, and attaching the nozzle plates to the substrates is a relatively time consuming process and requires specialized equipment.

Fluid chambers and ink feed channels for directing fluid to each of the ejection actuator devices on the semiconductor chip are either formed in the nozzle plate material or in a separate thick film layer. In a center feed design for a top-shooter type micro-fluid ejection head, fluid is supplied to the fluid channels and fluid chambers from a slot or ink via which is formed by chemically etching, dry etching, or grit blasting through the thickness of the semiconductor substrate. The substrate, nozzle plate and flexible circuit assembly is typically bonded to a thermoplastic body using a heat curable and/or radiation curable adhesive to provide a micro-fluid ejection head structure.

In order to decrease the cost and increase the production rate of micro-fluid ejection heads, newer manufacturing techniques using less expensive equipment is desirable. These techniques, however, must be able to produce ejection heads suitable for the increased quality and speed demanded by consumers. Thus, there continues to be a need for manufacturing processes and techniques which provide improved micro-fluid ejection head components.

SUMMARY OF THE EMBODIMENTS

The disclosure provides a method of making a micro-fluid ejection head structure. A device surface of a substrate is dry-sprayed with a polymeric material (e.g., a photoresist material) to provide a spray-coated layer on the surface of the substrate. The spray-coated layer has a thickness ranging from about 0.5 to about 20 microns. Flow features are formed (e.g., imaged and developed) in the spray coated layer. A nozzle plate layer is applied to the spray-coated layer. The nozzle plate layer has a thickness ranging from about 5 to about 40 microns and contains nozzle holes therein to provide the micro-fluid ejection head structure.

In another embodiment there is provided a method of making a micro-fluid ejection head structure. A device surface of a substrate is dry-sprayed with a layer of photoresist material to provide a spray-coated layer on the surface of the substrate. The spray-coated layer has a thickness ranging from about 0.5 to about 20 microns. Fluid chambers and fluid supply channels are imaged in the spray-coated layer. A polymeric material is applied to the spray-coated layer. The polymeric material has a thickness ranging from about 5 to about 40 microns. Nozzle holes are formed in the polymeric material. The fluid chambers and fluid supply channels imaged in the spray-coated layer are then developed in the spray-coated layer.

In yet another embodiment, there is provided a micro-fluid ejection head structure including a semiconductor substrate having at least one fluid supply slot formed therein and containing a plurality of fluid ejection actuators on a device surface thereof adjacent at least one edge of the fluid supply slot. A dry-sprayed photoresist layer is applied to the device surface of the substrate. The dry-sprayed layer provides fluid supply channels from the fluid supply slot and corresponding fluid chambers for each of the fluid ejection actuators and fluid supply channels. A nozzle plate layer is applied to the dry-sprayed photoresist layer as a dry film. The nozzle plate film layer contains a nozzle hole for each of the fluid chambers. Each nozzle hole is formed in the nozzle plate film layer after the nozzle plate film layer is applied to the dry-sprayed photoresist layer.

An advantage of the exemplary embodiments described herein is that they provide an improved micro-fluid ejection head structure and method for making the micro-fluid ejection head structure so as to avoid forming then attaching individual nozzle plates to a semiconductor substrate. Because the nozzle plate attaching step is avoided, alignment of the flow features in the nozzle plate with the ink ejection devices on the semiconductor substrate is greatly improved. Unlike spin-coating techniques used to apply photoresist materials to a wafer before fluid feed slots are formed in the substrates on the wafer, an exemplary embodiment of the disclosure provides a dry-spraying technique that enables the photoresist material for the flow features to be applied to the wafer after the fluid feed slots are formed in the substrates. The embodiments described herein also enable production of micro-fluid ejection heads having variable nozzle plate thicknesses without substantially affecting the planarity of the nozzle plate chip assembly.

BRIEF DESCRIPTION OF THE DRAWINGS

Further features and advantages of the disclosed embodiments will become apparent by reference to the detailed description when considered in conjunction with the figures, which are not to scale, wherein like reference numbers indicate like elements through the several views, and wherein.

DETAILED DESCRIPTION OF THE EMBODIMENTS

Figure 1:
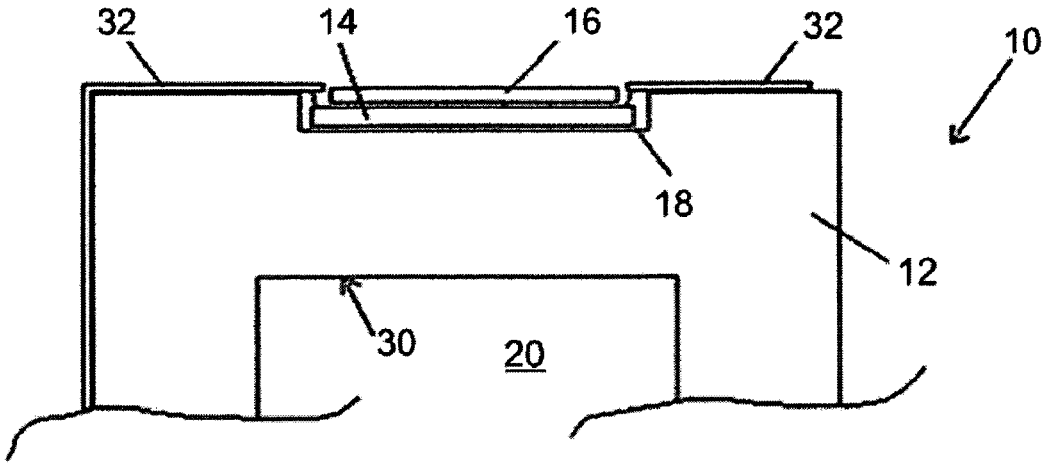
FIG. 1 Prior Art
FIGS. 1 and 2 are cross-sectional views, not to scale, of portions of a prior art micro-fluid ejection head.

With reference to FIG. 1, there is shown a simplified representation of a portion of a prior art micro-fluid ejection head 10, for example an ink jet printhead, viewed from one side and attached to a fluid cartridge body 12. The ejection head 10 includes a semiconductor substrate 14 and a nozzle plate 16. For conventional ink jet printheads, the nozzle plate 16 is formed in a film, excised from the film and attached as a separate component to the semiconductor substrate 14 using an adhesive. The substrate/nozzle plate assembly 14/16 is attached in a chip pocket 18 in the cartridge body 12 to form the ejection head 10. Fluid to be ejected is supplied to the substrate/nozzle plate assembly 14/16 from a fluid reservoir 20 in the cartridge body 12 generally opposite the chip pocket 18.

The cartridge body 12 may be made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. A preferred polymeric material for making the cartridge body 12 is NORYL SE1 polymer.

Figure 2:
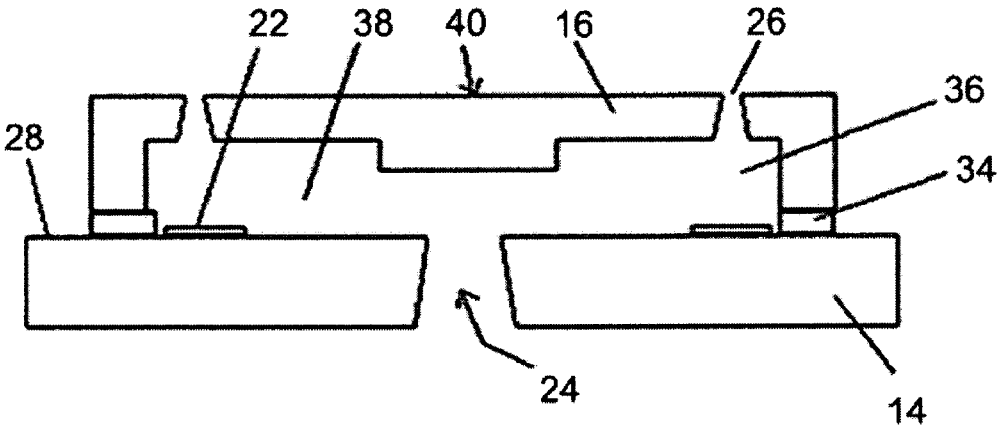
FIG. 2 Prior Art

The semiconductor substrate 14 is preferably a silicon semiconductor substrate 14 containing a plurality of fluid ejection actuators such as piezoelectric devices or heater resistors 22 formed on a device side 24 of the substrate 14 as shown in the simplified illustration of FIG. 2. Upon activation of heater resistors 22, fluid supplied through a fluid supply slot 24 in the semiconductor substrate 14 is caused to be ejected through nozzle holes 26 in nozzle plate 16. Fluid ejection actuators, such as heater resistors 22, are formed on a device side 28 of the semiconductor substrate 14 by well known semiconductor manufacturing techniques.

The semiconductor substrates 14 are relatively small in size and typically have overall dimensions ranging from about 2 to about 8 millimeters wide by about 10 to about 20 millimeters long and from about 0.4 to about 0.8 mm thick. In conventional semiconductor substrates 14, the fluid supply slots 24 are grit-blasted in the semiconductor substrates 14. Such slots 24 typically have dimensions of about 9.7 millimeters long and 0.39 millimeters wide. Fluid may be provided to the fluid ejection actuators by a single slot 24 or by a plurality of openings in the substrate 14 made by a dry etch process selected from reactive ion etching (RIE) or deep reactive ion etching (DRIE), inductively coupled plasma etching, and the like.

The fluid supply slots 24 direct fluid from the reservoir 20 which is located adjacent fluid surface 30 of the cartridge body 12 (FIG. 1) through a passage-way in the cartridge body 12 and through the fluid supply slots 24 in the semiconductor substrate 14 to the device side 28 of the substrate 14 containing heater resistors 22 (FIGS. 1 and 2). The device side 28 of the substrate 14 also preferably contains electrical tracing from the heater resistors 22 to contact pads used for connecting the substrate 14 to a flexible circuit or a tape automated bonding (TAB) circuit 32 (FIG. 1) for supplying electrical impulses from a fluid ejection controller to activate one or more heater resistors 22 on the substrate 14.

Prior to attaching the substrate 14 to the cartridge body 12, the nozzle plate 16 is attached to the device side 28 of the substrate by use of one or more adhesives 34. The adhesive 34 used to attach the nozzle plate 16 to the substrate 14 is preferably a heat curable adhesive such as a B-stageable thermal cure resin, including, but not limited to phenolic resins, resorcinol resins, epoxy resins, ethylene-urea resins, furane resins, polyurethane resins and silicone resins. A particularly preferred adhesive 34 for attaching the nozzle plate 16 to the substrate 14 is a phenolic butyral adhesive which is cured using heat and pressure. The nozzle plate adhesive 34 is preferably cured before attaching the substrate/nozzle plate assembly 14/16 to the cartridge body 12.

As shown in detail in FIG. 2, a conventional nozzle plate 16 contains a plurality of the nozzle holes 26 each of which are in fluid flow communication with a fluid chamber 36 and a fluid supply channel 38 which are formed in the nozzle plate material from a side attached to the semiconductor substrate 14 as by laser ablation of the nozzle plate material. The fluid chamber 36, fluid supply channel 38, and nozzle hole 26 are referred to collectively as "flow features." After laser ablating the nozzle plate 16, the nozzle plate 16 is washed to remove debris therefrom. Such nozzle plates 16 are typically made of polyimide which may contain an ink repellent coating on a surface 40 thereof. Nozzle plates 16 may be made from a continuous polyimide film containing the adhesive 34. The film is preferably either about 25 or about 50 mm thick and the adhesive is about 12.5 mm thick. The thickness of the film is fixed by the manufacturer thereof. After forming flow features in the film for individual nozzle plates 16, the nozzle plates 16 are excised from the film.

Figure 3:
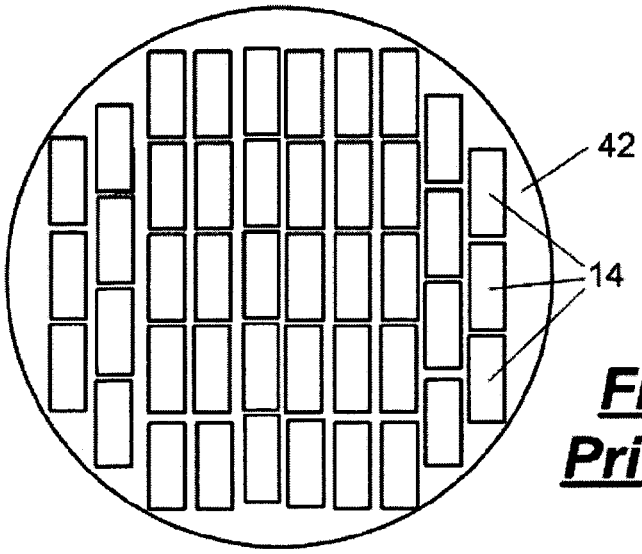
FIG. 3 Prior Art
FIG. 3 is a plan view, not to scale, of a semiconductor wafer containing a plurality of semiconductor substrates.

The excised nozzle plates 16 are attached to a wafer 42 containing a plurality of semiconductor substrates 14 (FIG. 3). An automated device is used to optically align the nozzle holes 26 in each of the nozzle plates 16 with heater resistors 22 on a semiconductor substrate 14 and attach the nozzle plates 16 to the semiconductor substrates 14. Misalignment between the nozzle holes 26 and the heater resistors 22 may cause problems such as misdirection of ink droplets from the ejection head 10, inadequate droplet volume or insufficient droplet velocity. The laser ablation equipment and automated nozzle plate attachment devices are costly to purchase and maintain. Furthermore it is often difficult to maintain manufacturing tolerances using such equipment in a high speed production process. Slight variations in the manufacture of each unassembled component are magnified significantly when coupled with machine alignment tolerances to decrease the yield of printhead assemblies.

The disclosed embodiments, as set forth therein, greatly improve alignment between the nozzle holes 26 and the heater resistors 22 and uses less costly equipment thereby providing an advantage over conventional micro-fluid ejection head manufacturing processes. The disclosed embodiments also provide for variations in nozzle plate thicknesses that are not limited by available film materials used for making the nozzle plates.

Figure 4A:
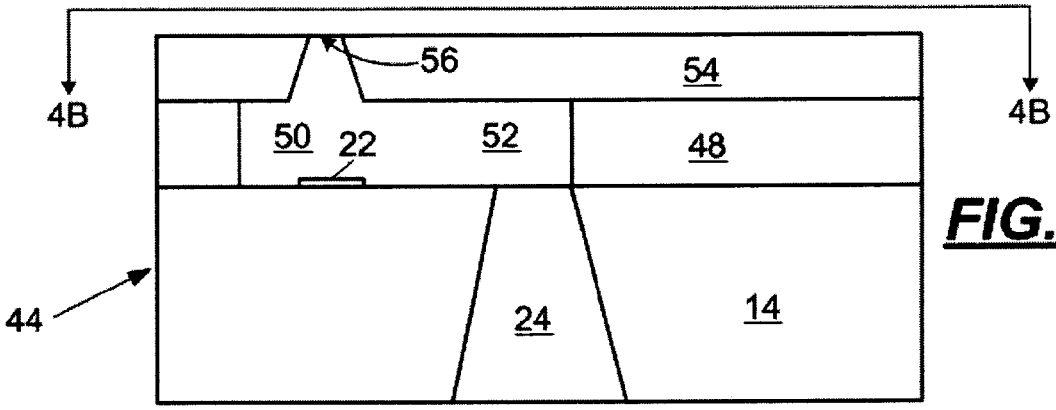
FIG. 4A is a cross-sectional view, not to scale of a portion of a micro-fluid ejection head according to one of the embodiment of the disclosure.
Figure 4B:
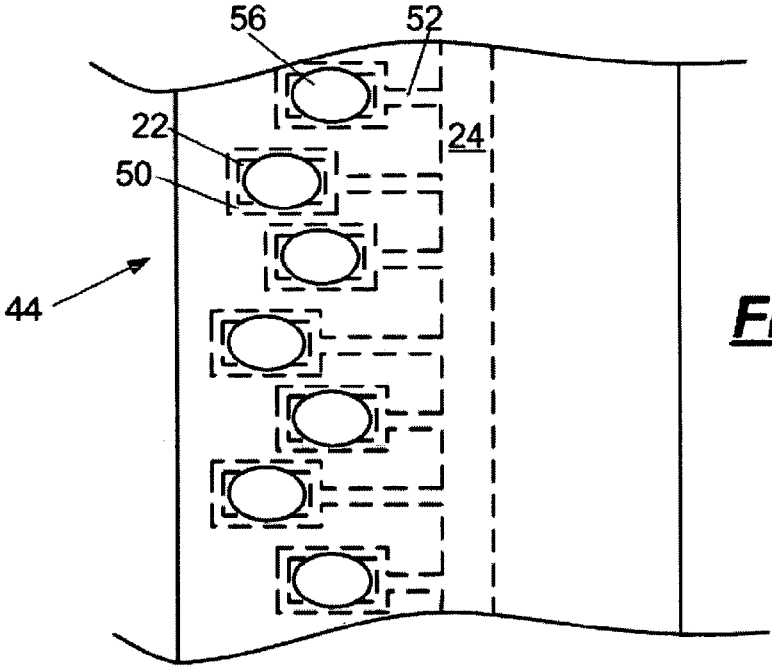
FIG. 4B is a plan view, not to scale, of a portion of a micro-fluid ejection head according to one embodiment of the disclosure.

A nozzle plate/substrate assembly 44 according to the embodiments of the disclosure is illustrated in simplified views in FIGS. 4A and 4B. According to the disclosure, fluid chambers 50 and fluid channels 52 are provided in a first photo-imaged polymer layer 48 which is dry-sprayed onto the substrate 14 from a mixture of polymer and highly volatile carrier fluid. A nozzle plate layer 54 is applied to the first polymeric layer 48 to provide nozzle holes 56 corresponding to the fluid chambers 50.

Unlike spin-coating techniques which cannot be easily used once the fluid supply slots 24 are in the substrate 14, the dry-spraying process enables a polymeric material, such as a positive or negative photoresist material, to be sprayed onto the surface 28 of the substrate 14 in an essentially dry form (e.g., in some embodiments the material may be somewhat wet or tacky depending, for example, on the solvents used). Accordingly, the polymeric material forming layer 48 does not flow into and coat or fill the fluid supply slots 24 during the application process.

Suitable polymeric materials for the first and second layers 48 and 54 may include materials selected from the group consisting of epoxies, acrylates, polyimides, novalac, diazonaphthaquinone, cyclized rubber, chemically amplified photoresists and the like. For, example positive or negative photoresist materials which may be used for layers 48 and 54 include, but are not limited to acrylic and epoxy-based photoresists such as the photoresist materials available from Clariant Corporation of Somerville, N.J. under the trade names AZ4620 and AZ1512. Other photoresist materials are available from Shell Chemical Company of Houston, Tex. under the trade name EPON SU8 and photoresist materials available Olin Hunt Specialty Products, Inc. which is a subsidiary of the Olin Corporation of West Paterson, N.J. under the trade name WAYCOAT. A preferred photoresist material includes from about 10 to about 20 percent by weight difunctional epoxy compound, less than about 4.5 percent by weight multifunctional crosslinking epoxy compound, from about 1 to about 10 percent by weight photoinitiator capable of generating a cation and from about 20 to about 90 percent by weight non-photoreactive solvent as described in U.S. Pat. No. 5,907,333 to Patil et al., the disclosure of which is incorporated by reference herein as if fully set forth.

In order to dry-spray the photoresist material onto the surface 28 of the substrate 14, a highly volatile carrier fluid is used. The carrier fluid may include a single volatile component or a mixture of volatile components. Suitable carrier fluids include but are not limited to toluene, xylene, methyl ethyl ketone, acetone, and mixtures thereof. For example a mixture of carrier fluid containing 80 weight percent methyl ethyl ketone and 20 weight percent acetophenone may be used. It is preferred that the volatile carrier fluid comprise from about 50 to about 97 percent by weight of the mixture of photoresist material and carrier fluid.

An exemplary mixture suitable for dry spraying may include 9.3 percent by weight difunctional epoxy resin derived from diglycidal ether and bis-phenol-A available from Shell Chemical Company of Houston, Tex. under the trade name EPON 1007F, 2.0 percent by weight of a cationic photoinitiator containing a mixture of triarylsulfonium hexafluoroantimonate salts in propylene carbonate available from Union Carbide Corporation under the trade name CYRACURE UVI-6976, 0.2 percent by weight gamma-glycidoxypropyltrimethoxy-silane, 16.5 percent by weight acetophenone, and 72.0 percent by weight methyl ethyl ketone. The mixture may be spray coated onto the surface 28 of the substrate 14, using commercially available spray coating equipment such as the spray coating equipment available from the EV Group of Phoenix, Ariz. under the trade names EVG-101 and EVG-150.

During the dry-spraying step of the process, the polymeric material and carrier fluid are sprayed toward the surface 28 of the substrate. As the mixture is sprayed, the liquid portion of the mixture, or carrier fluid, substantially evaporates before the mixture impacts on the surface 28 of the substrate or shortly after the mixture impacts the surface such that the mixture has insufficient fluid properties for the polymeric material to flow and fill the fluid supply slots 24 in the substrate 14. Accordingly, the polymeric material providing layer 48 may be applied to a substrate 14 containing openings or fluid supply slots 24 therein, as opposed to a spin coating technique that is difficult to manage when the substrate 14 contains holes or slots 24 therein.

The dry-spray coated layer 48 may be a single layer or may include a plurality of layers provided by a plurality of dry-spraying steps. The thickness of the dry-spray coated layer 48 may range from about 0.5 to 20 microns or more.

Figure 5:
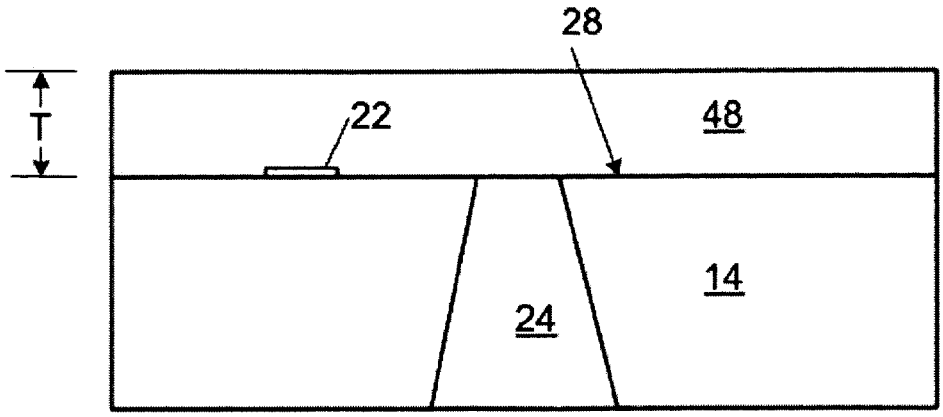
FIGS. 5–10 are schematic views, not to scale, of steps in processes for making micro-fluid ejection heads according to one embodiment of the disclosure.
Figure 6:
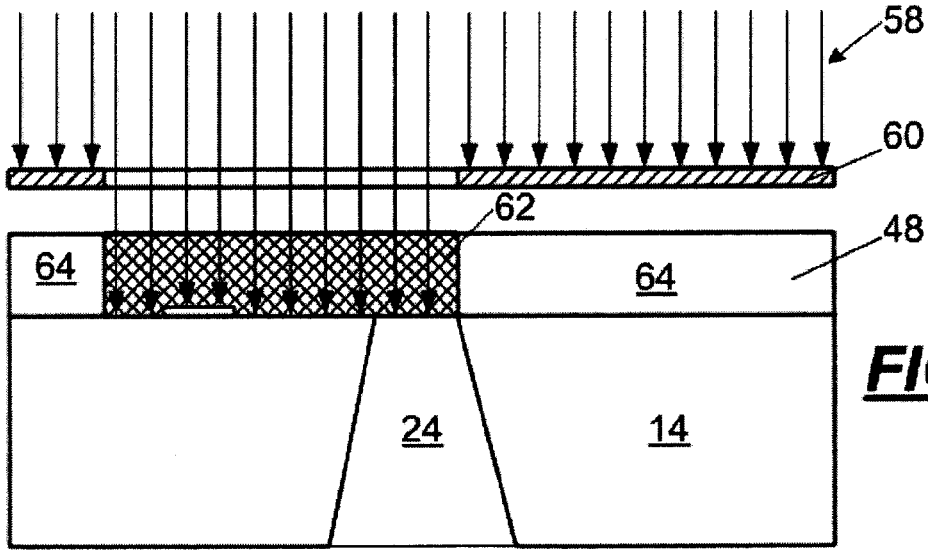
Figure 7:
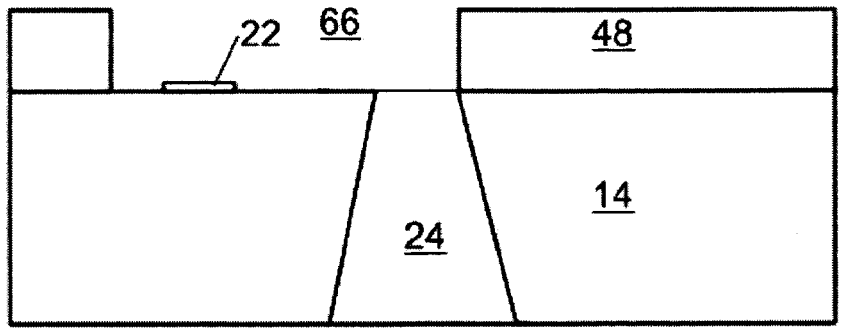
Figure 8:
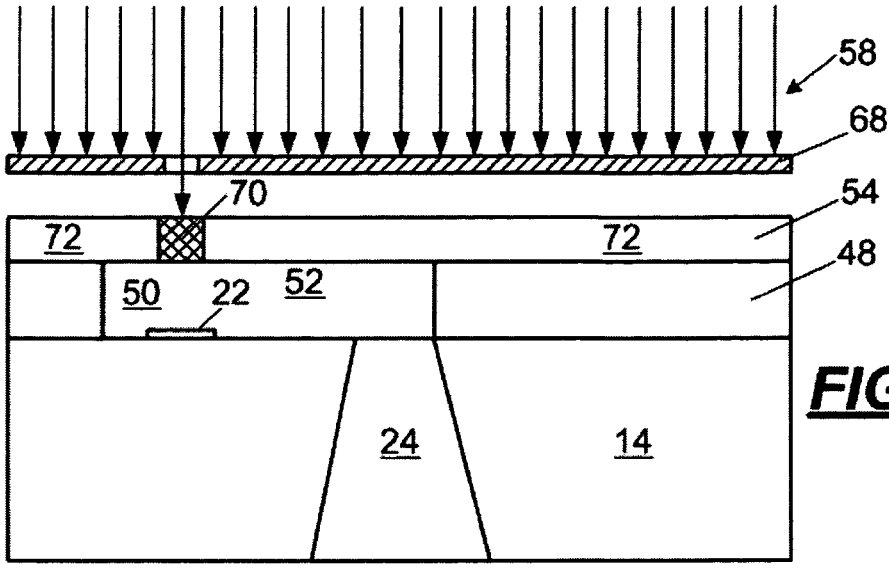

Once the desired thickness of the spray-coated layer 48 is provided on the surface 28 of the substrate 14, the layer 48 may be imaged and developed to provide the fluid chambers 50 and fluid supply channels 52. In one embodiment, illustrated in FIGS. 5–8, the first layer 48 is dry-sprayed onto the device surface 28 of the substrate 14 to a desired thickness T (FIG. 5). Next, the spray-coated layer is imaged, as by ultraviolet (UV) radiation 58 through a mask 60 to provide an imaged area 62 and a non-imaged area 64. In this embodiment, the first layer is provided by a positive photoresist material. Accordingly, the exposed area 62 may be developed by a conventional developing technique, described below, to provide a developed area 66 as shown in FIG. 7 which will become the fluid chamber 50 and fluid supply channel 52 of the nozzle plate/substrate assembly 44 (FIGS. 4A–4B).

Next, the nozzle layer 54 is applied to the imaged and developed layer 48. In this example, the nozzle plate layer 54 is also a positive photoresist material, with may be applied to the first layer 48 as by an adhesive, thermal compression bonding, or other laminating technique. The nozzle plate layer 54 is also imaged through a mask 68 as by UV radiation to provide an imaged area 70 and a non-imaged area 72. Upon developing the second layer 54, the imaged area 70 becomes the nozzle hole 56 (FIGS. 4A–4B).

Figure 9:
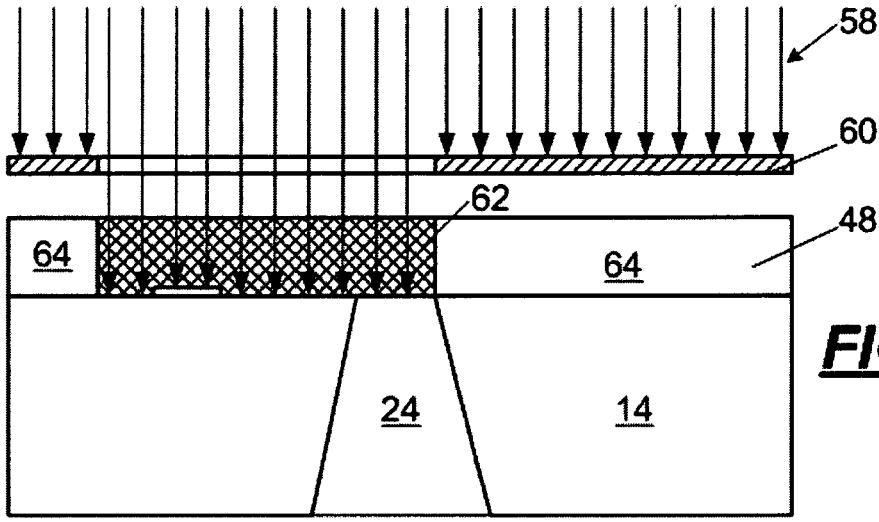
Figure 10:
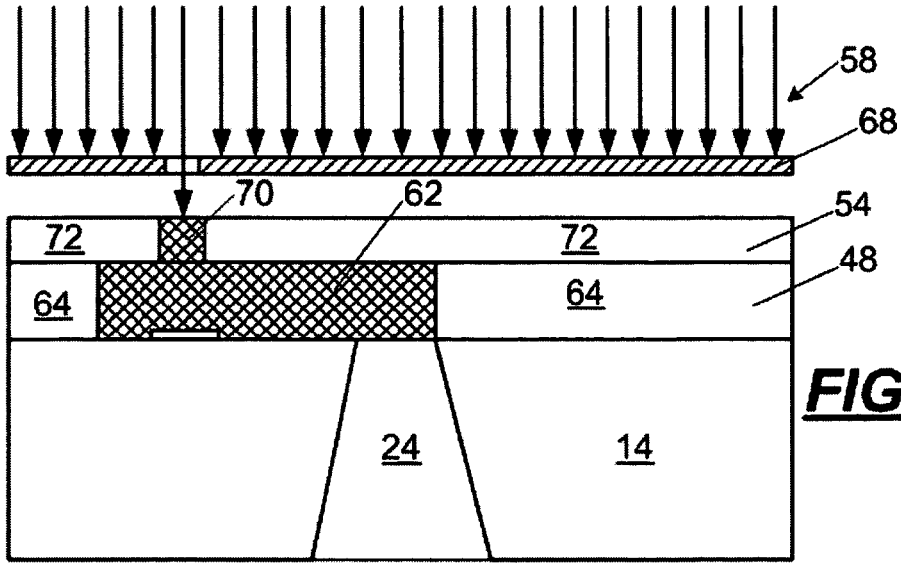

In an alternative embodiment, illustrated in FIGS. 9–10, the first layer 48 is imaged as described above, however, the layer 48 is not developed to provide the developed area 66. Next, the second layer 54 is applied to the first layer 48. In this embodiment, the second layer 54 may be applied to the first layer 48 as by an adhesive, thermal compression bonding, or other laminating technique. If a photoresist material is used as the second layer 54, the second layer 54 may be imaged, and the first and second layers 48 and 54 may be developed to remove the exposed materials 62 and 70 from the layers 48 and 54. If a non-photoimageable material is used as the second layer 54, holes may be formed in the second layer 54, as by dry etching, laser drilling, laser ablation, and the like. The exposed area 62 may be developed after the second layer is applied, either before or after the nozzle hole 56 is formed in the second layer 54.

It will be appreciated that the foregoing layers 48 and 54 may be provided by a positive photoresist material, a negative photoresist material, or a combination of positive and negative photoresist material. It will also be appreciated that layer 54 may be provided by a wide variety of materials which may or may not be photoimageable.

The exposed areas 62 and 70 may be developed through the nozzle hole 56 and/or through the fluid supply slot 24 by conventional resist development means such as solvent stripping, wet etching or plasma ashing techniques. A preferred method for developing the exposed areas 62 and 70 is the use of butyl cellusolve acetate or butyl acetate.

As described above, the foregoing process enables layers 48 and 54 for micro-fluid flow features to be applied to the substrate 14 containing fluid supply slots 24 therein. The fluid supply slots 24 may be formed in the substrate 14 by a variety of techniques. A preferred technique for forming the fluid supply slots 24 is a deep reactive ion etching technique. According to the technique, the substrate wafer 42 is placed in an etch chamber having a source of plasma gas and back side cooling such as with helium, water or liquid nitrogen. It is preferred to maintain the substrate wafer 42 below about 185° C., most preferably in a range of from about 50° to about 80° C. during the etching process. During the process, etching of the substrate is conducted using an etching plasma derived from $SF_6$ and a passivating plasma derived from $C_4F_8$ wherein the semiconductor wafer 42 is etched from a side opposite the device surface 28 of the substrate 14.

During the etching process, the plasma is cycled between the passivating plasma step and the etching plasma step until the fluid supply slot 24 is etched completely through the substrate 14. Cycling times for each step preferably range from about 5 to about 20 seconds per step. Gas pressure in the etching chamber preferably ranges from about 15 to about 50 millitorrs at a temperature ranging from about −20° to about 35° C. The DRIE platen power preferably ranges from about 10 to about 25 watts and the coil power preferably ranges from about 800 watts to about 3.5 kilowatts at frequencies ranging from about 10 to about 15 MHz. Etch rates may range from about 2 to about 10 microns per minute or more and produce vias having side wall profile angles ranging from about 88° to about 92°. Dry-etching apparatus suitable for forming ink vias 24 is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al.

After developing the exposed areas 62 and 70 in layers 48 and 54, individual nozzle plates/substrate assemblies 44 may be excised from the semiconductor wafer 42 containing a plurality of nozzle plate/substrate assemblies 44. The nozzle plate/substrate assembly 44 is electrically connected to the flexible circuit or TAB circuit 32 (FIG. 1) and the nozzle plate/substrate assembly 44 is attached to the cartridge body 12 using a die attach adhesive. The nozzle plate/substrate assembly 44 is preferably attached to the cartridge body 12 in the chip pocket 18 as described above with reference to FIG. 1. The die attach adhesive preferably seals around the edges of the semiconductor substrate 14 to provide a liquid tight seal to inhibit ink from flowing between edges of the substrate 14 and the chip pocket 18.

The die attach adhesive used to attach nozzle plate/substrate assembly 44 to the cartridge body 12 is preferably an epoxy adhesive such as a die attach adhesive available from Emerson & Cuming of Monroe Township, N.J. under the trade name ECCOBOND 3193-17. In the case of a nozzle plate/substrate assembly 44 that requires a thermally conductive cartridge body 12, the die attach adhesive is preferably a resin filled with thermal conductivity enhancers such as silver or boron nitride. A preferred thermally conductive die attach adhesive is POLY-SOLDER LT available from Alpha Metals of Cranston, R.I. A suitable die attach adhesive containing boron nitride fillers is available from Bryte Technologies of San Jose, Calif. under the trade designation G0063. The thickness of adhesive preferably ranges from about 25 microns to about 125 microns. Heat is typically required to cure the die attach adhesive and fixedly attach the nozzle plate/substrate assembly 44 to the cartridge body 12.

Once the nozzle plate/substrate assembly 44 is attached to the cartridge body 12, the flexible circuit or TAB circuit 32 is attached to the cartridge body 12 as by use of a heat activated or pressure sensitive adhesive. Preferred pressure sensitive adhesives include, but are not limited to phenolic butyral adhesives, acrylic based pressure sensitive adhesives such as AEROSET 1848 available from Ashland Chemicals of Ashland, Kentucky and phenolic blend adhesives such as SCOTCH WELD 583 available from 3M Corporation of St. Paul, Minn. The pressure sensitive adhesive preferably has a thickness ranging from about 25 to about 200 microns.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A method of making a micro-fluid ejection head structure comprising:

dry-spraying a device surface of a substrate with a photoresist material to provide a spray-coated layer on the surface of the substrate, the spray-coated layer having a thickness ranging from about 0.5 to about 20 microns;

imaging and developing flow features in the spray-coated layer; and applying a nozzle plate layer to the spray-coated layer, the nozzle plate layer having a thickness ranging from about 5 to about 40 microns and containing nozzle holes therein.

2. The method of claim 1 wherein the dry-spraying comprises spray coating a photoresist material in a highly volatile carrier fluid onto the device surface of the substrate whereby the carrier fluid substantially evaporates so that the photoresist material is applied to the substrate in solid rather than liquid form.

3. The method of claim 2 wherein the dry-spraying comprises spray coating two or more spray-coated layers onto the device surface of the substrate.

4. The method of claim 1 wherein the nozzle plate layer comprises a dry film photoresist layer that is applied to the spray-coated layer using an adhesive.

5. The method of claim 1 wherein the nozzle plate layer comprises a dry film photoresist that is laminated to the spray-coated layer using thermal compression bonding or roll lamination.

6. The method of claim 5 further comprising an act of forming nozzle holes in the nozzle plate layer by patterning and developing the nozzle plate layer.

7. The method of claim 1 further comprising an act of forming nozzle holes in the nozzle plate layer by dry etching the nozzle plate layer.

8. The method of claim 1 wherein the spray-coated layer comprises a negative photoresist layer.

9. The method of claim 1 wherein the nozzle plate layer comprises a negative photoresist layer.

10. The method of claim 1 wherein the spray-coated layer comprises a composition selected from the group consisting essentially of epoxy, acrylate, polyimide, novolac, diazonaphthaquinone, cyclized rubber, and chemically amplified photoresists.

11. The method of claim 1 wherein the nozzle plate layer comprises a composition selected from the group consisting essentially of epoxy, acrylate, polyimide, novolac, diazonaphthaquinone, cyclized rubber, and chemically amplified photoresists.

12. The method of claim 1 wherein the micro-fluid ejection device head structure comprises an inikjet printhead.

13. A method of making a micro-fluid ejection head structure comprising:

dry-spraying a device surface of a substrate with a layer of photoresist material to provide a spray-coated layer on the surface of the substrate, the spray-coated layer having a thickness ranging from about 0.5 to about 20 microns;

imaging fluid chambers and fluid supply channels in the spray-coated layer;

applying a polymeric material to the spray-coated layer, the polymeric material having a thickness ranging from about 5 to about 40 microns;

forming nozzle holes in the polymeric material; and developing the fluid chambers and fluid supply channels imaged in the spray-coated layer.

14. The method of claim 13 wherein the dry-spraying act comprises spray coating a photoresist material in a highly volatile carrier fluid onto the device surface of the substrate whereby the carrier fluid substantially evaporates so that the photoresist material is applied to the substrate in solid rather than liquid form.

15. The method of claim 13 wherein the dry-spraying act comprises spray coating two or more spray-coated layers onto the device surface of the substrate.

16. The method of claim 13 wherein the polymeric material comprises a dry film photoresist layer and wherein the dry film photoresist layer is laminated to the spray-coated layer.

17. The method of claim 16 wherein the act of forming nozzle holes in the dry film photoresist layer comprises patterning and developing the dry film photoresist.

18. The method of claim 16 wherein the act of forming nozzle holes in the dry film photoresist layer comprises dry etching the dry film photoresist layer.

19. The method of claim 13 wherein the polymeric material comprises a dry film photoresist layer and wherein the dry film photoresist layer is laminated to the spray-coated layer using thermal compression bonding or roll lamination.

20. The method of claim 19 wherein the act of forming nozzle holes in the dry film photoresist layer comprises dry etching the dry film photoresist layer.

21. The method of claim 13 wherein the polymeric material comprises a negative photoresist layer.

22. The method of claim 13 wherein the spray-coated layer comprises a composition selected from the group consisting essentially of epoxy, acrylate, polyimide, novolac, diazonaphthaquinone, cyclized rubber, and chemically amplified photoresists.

23. The method of claim 13 wherein the polymeric material comprises a composition selected from the group consisting essentially of epoxy, acrylate, polyimide, novolac, diazonaphthaquinone, cyclized rubber, and chemically amplified photoresists.

24. The method of claim 13 wherein the micro-fluid ejection device head structure comprises an inikjet printhead.

25. A method of making a micro-fluid ejection head structure comprising:

dry-spraying a device surface of a substrate with a polymeric material to provide a spray-coated layer on the surface of the substrate, the spray-coated layer having a thickness ranging from about 0.5 to about 20 microns;

forming flow features in the spray-coated layer; and applying a nozzle plate layer to the spray-coated layer, the nozzle plate layer having a thickness ranging from about 5 to about 40 microns and containing nozzle holes therein.

26. The method of claim 25, wherein the forming flow features act comprises imaging and developing flow features in the spray-coated layer, wherein the polymeric material comprises a photoresist material.

* * * * *